US006035902A

United States Patent [19]

Dixon

[11] Patent Number: 6,035,902

[45] Date of Patent: Mar. 14, 2000

[54] FAIL-SAFE POWER STEERING SERVICE MACHINE

[75] Inventor: Patrick Lewis Dixon, Gilbert, Ariz.

[73] Assignee: Wynn Oil Company, Azusa, Calif.

[21] Appl. No.: 09/105,928

[22] Filed: Jun. 27, 1998

[51] Int. Cl.[7] ..... B65B 1/04

[52] U.S. Cl. ..... 141/98; 141/59; 141/65

[58] Field of Search ..... 141/98, 65, 59; 184/1.5; 123/196 R

[56] References Cited

U.S. PATENT DOCUMENTS 4,860,804 8/1989 Yamaguchi et al. ..... 141/65

5,415,247 5/1995 Knorr ..... 184/1.5

5,518,047 5/1996 Alexandrowski ..... 141/65

*Primary Examiner*—Steven O. Douglas

*Attorney, Agent, or Firm*—Terry L. Miller

[57] ABSTRACT

A fail-safe service machine for the power steering system of automotive vehicles includes a pair of pumps each driven by electrical power from a vehicle under service, and a suction/delivery probe extending into the power steering system reservoir of the vehicle, both to remove old power steering fluid, and to simultaneously deliver new power steering fluid.

9 Claims, 1 Drawing Sheet

FAIL-SAFE POWER STEERING SERVICE MACHINE

BACKGROUND OF THE INVENTION

1. Field of the Invention

The present invention is in the field of machines and methods used to service automotive power steering systems. More particularly, the present invention relates to a machine and method for removing the old and contaminated power steering fluid from an automotive power steering system, while simultaneously replacing the old fluid with new fluid as the automotive vehicle runs to activate the power steering system. The machine and method according to the present invention are fail-safe, such that damage to the power steering system from running dry cannot happen even from inattention or neglect on the part of a service technician.

2. Related Technology

A conventional machine for service of the power steering system of an automobile or other automotive vehicle is known in accord with U.S. Pat. No. 5,415,247, issued May 16, 1995 to Robert Knorr. The '247 patent is believed to teach a power steering fluid exchange machine for use with the power steering of an automotive vehicle, such as a truck or automobile. The Knorr '247 patent appears to utilize two electric motor driven pump units which are operated simultaneously, one withdrawing old power steering fluid from the reservoir of a power steering system, and the other simultaneously delivering new power steering fluid from a supply into the reservoir of the power steering system. The motor driven pump units are powered by electrical power from the vehicle under service, and the engine of the vehicle under service is running with the steering turned to one extreme of its motion, assertedly to open the valves of the power steering system.

Unfortunately, the service machine according to the '247 patent has a serious shortcoming, and the explanation of its use in cooperation with the power steering system of a vehicle while the vehicle is operating evidences a lack of understanding about the workings of automotive power steering systems. That is, the Knorr '247 patent specifically teaches and claims a power steering service machine of the type described in which a first conduit delivers fresh power steering fluid into an upper part of the reservoir of the power steering system (i.e., at a first level). A second conduit extends into the reservoir to a level below the first level, and withdraws old power steering fluid from the reservoir of the system while the engine of the vehicle is running.

However, in the event that the service technician allows the supply of new power steering fluid to run out while the service procedure is in process, and does not stop the process before the service machine withdraws substantially all of the fluid from the power steering system, then the power steering pump of the vehicle may be seriously damaged or destroyed by running dry of power steering fluid. This is clearly the case because the Knorr '247 patent teaches to withdraw the old fluid (i.e., any fluid in the reservoir of the power steering system) at a low level, and to deliver the new fluid at a higher level. Ostensibly, this difference in deliver and withdrawal levels for the fluid minimized admixture of the new fluid with the old and effects an economy in the amount of new power steering fluid needed to effect a service for a vehicle. However, the risk of damage to the power steering pump of a vehicle being serviced is too great, and the cost of power steering fluid is minimal in comparison to the cost of replacing a damaged power steering pump.

Still further, the Knorr '247 patent teaches that during a service procedure for a power steering system, the machine taught by this patent is used, and the steering of the vehicle under service is turned to one extreme or the other while the engine of the vehicle runs. This turning of the vehicle steering to one extreme is said to open the valves of the power steering system and allow substantially all of the old fluid to be flushed from the system. Knorr recommends use of a strap or belt to hold the vehicle's steering wheel in the extreme right ward position for this purpose.

Unfortunately, the explanation provided by Knorr is not a true or complete representation of the operation of an automotive power steering system. That is, automotive power steering systems of the common type found on automobiles, for example, are open-centered hydraulic servo systems operating in conjunction with a mechanical steering gear which provides a positive driving engagement between the steering wheel of the vehicle and the steering linkage moving the dirigible wheels of the vehicle for steering movements. A power steering pump of the vehicle is operated by the vehicle engine when this engine is running, and draws power steering fluid at ambient pressure from a reservoir, pressurizes this fluid, and sends the fluid to an open-centered hydraulic servo control valve of the power steering system.

The open-centered hydraulic servo control valve is associated with the steering wheel of the vehicle by connection with a steering input shaft, and receives steering input movements from the steering wheel as these movements are transferred to the steering linkage of the vehicle. This control valve moves from an open-centered position to a partially closed/partially opened position in response to steering torque at the steering wheel reaching a certain threshold.

The servo control valve is associated with a hydraulic actuator, which is double acting so as to provide an assist in driving the dirigible wheels toward a steering position selected by the position of the steering wheel of the vehicle. When the open-centered servo control valve is in its centered position, pressurized power steering fluid from the pump is communicated equally to both sides of the double acting actuator, providing a balanced force that does not effect a steering assist force. In this position of the control valve, fluid flows from the pump to the control valve, is throttled to a lower pressure, and returns to the reservoir of the pump. There is little of no actual flow of fluid from the control valve to or from either one of the sides of the double acting actuator.

On the other hand, when the control valve is moved, by a steering input applied at the steering wheel, for example, to a partially closed/partially open position, communication of pressurized fluid from the pump is increased to one side of the double-sided actuator, while communication of the fluid from the other side of the actuator to the fluid reservoir is increased. As a result, the actuator provides a force and movement in one steering direction, with the pressurized side of the actuator receiving pressurized fluid, and the movement of the actuator displacing fluid from the low-pressure side of the actuator to the fluid reservoir of the power steering system. Thus, the expedient recommended by Knorr (keeping the steering wheel in one extreme of its position, would result in the actuator of the system not being flushed of old power steering fluid, and in this retained old fluid contaminating the new fluid as soon as the system is returned to service.

In order to remove the old fluid from a power steering system and replace this old fluid with new fluid, the actuator of the system must be exercised through its full movement as new fluid is supplied by the pump of the system to this actuator, and as the old fluid returned from the actuator to the fluid reservoir is removed.

SUMMARY OF THE INVENTION

In view of the deficiencies of the conventional technology, it is an object for this invention to avoid one or more of these deficiencies.

Further in view of the above, it is desirable and is an object of this invention to provide an improved fail-safe power steering service machine which allows the old fluid to be removed from a power steering system while simultaneously being replaced by new fluid, and with no risk that the power steering pump of the system can be damaged by dry running.

Accordingly, the present invention according to a particularly preferred exemplary embodiment of the invention provides a power steering service machine having a duality of pumps operating simultaneously, one pump withdrawing fluid from a level above the bottom of the power steering pump fluid reservoir of a power steering system being serviced, and the other pump delivering new power steering fluid from a source thereof to the reservoir of the power steering pump at a level preferably below and never higher than the level at which fluid is withdrawn from this reservoir by the first pump.

An advantage of the present invention resides in its counter-intuitive and deliberate allowance of a certain level of admixture of the new power steering fluid with the old power steering fluid still in the reservoir (and still elsewhere in the system) as this new fluid is added to the reservoir. This counter intuitive allowance of admixture of new fluid with old is allowed at the cost of a slight increase in the amount of new fluid which is required in order to service a power steering system, but results in the absolute failure safe operation of the present power steering service machine so far as possible damage to the power steering pump of the power steering system because of dry running is concerned.

Additional objects and advantages of the present invention will be apparent from a reading of the following detailed description of a singular exemplary preferred embodiment of the invention when taken in conjunction with the appended drawing Figures. Also, a better understanding of the present invention will be obtained from reading the following description of a single preferred exemplary embodiment of the present invention when taken in conjunction with the appended drawing Figures, in which the same features (or features analogous in structure or function) are indicated with the same reference numeral throughout the several views. It will be understood that the appended drawing Figures and description here following relate only to one or more exemplary preferred embodiments of the invention, and as such, are not to be taken as implying a limitation on the invention. No such limitation on the invention is implied, and none is to be inferred.

BRIEF DESCRIPTION OF THE DRAWING FIGURES

FIG. 1 provides a schematic representation of the power steering system of an exemplary automotive vehicle; and FIG. 2 provides a diagrammatic view of a reservoir of a power steering system with a suction/delivery probe of the present invention shown in place in this reservoir for purposes of service of the power steering system, and a dual pump service machine of the present invention also shown in schematic representation.

DETAILED DESCRIPTION OF AN EXEMPLARY

Preferred Embodiment of the Invention

Figure 1:
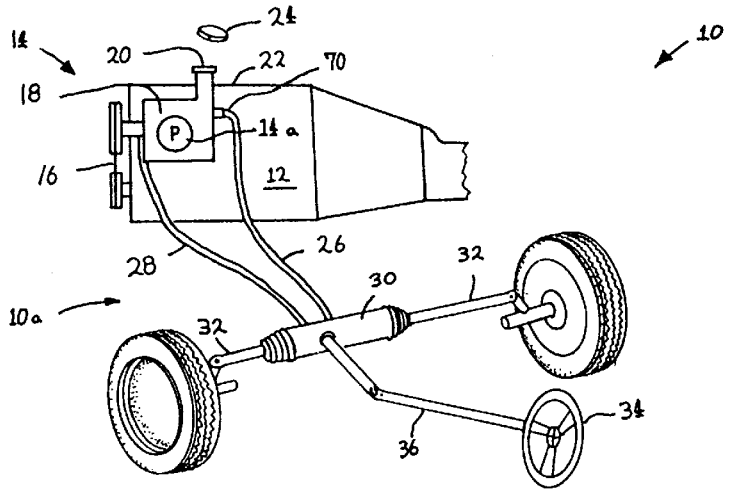

Viewing first FIG. 1, a vehicle 10 with a power steering system 10*a* includes an engine 12 driving a power steering pump 14 by means of a belt 16. This power steering pump 14 includes a reservoir portion 18 disposed generally above the actual pumping portion (indicated with the dashed circle, the character "P",and the numeral 14*a*) of the power steering pump 14. Those ordinarily skilled in the pertinent arts will recognize that although the pump 14*a* and the reservoir 18 may each be a separate structure, which are in that case interconnected by fluid conduits, conventional modern automotive practice provides the reservoir 18 as a structure in surrounding relationship to the pump 14*a*. The reservoir portion 18 has a fill opening 20, which in the illustrated case is disposed at the upper end of a fill tube 22 closed by a cap 24. Also, a low-pressure hose 26 connects onto a fitting on the body of the reservoir portion 18 in order to allow return of low pressure power steering fluid into this reservoir.

During operation of the engine 12, the pump 14*a* draws power steering fluid from the reservoir portion 18, and delivers this fluid pressurized via a high-pressure hose or conduit 28 to a power steering unit 30. The power steering unit 30 is in this case depicted as a power rack-and-pinion type unit, although, of course, the invention is not limited to use with this type or any other type of power steering gear of unit. This power steering unit 30 is connected to the dirigible wheels of the vehicle, for example, by tie rods 32, and has a steering input from a steering wheel 34 via a steering shaft 36.

Figure 2:
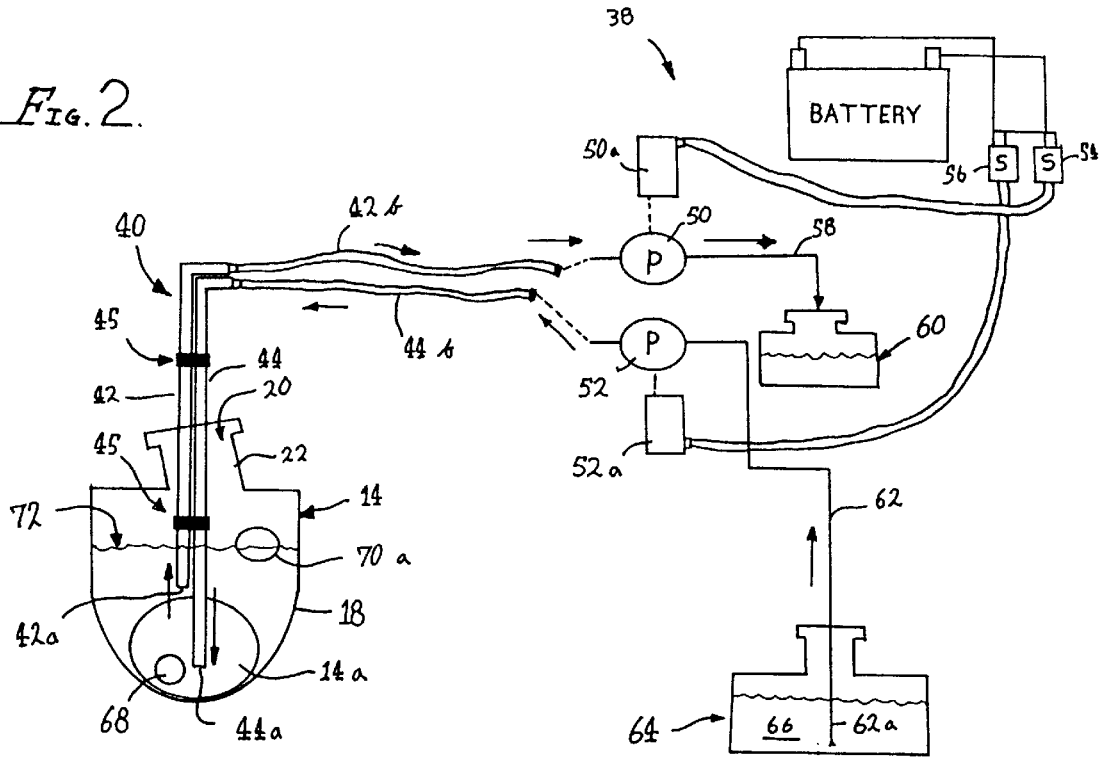

Now, as is seen in FIG. 2, in order to allow a power steering service machine 38 to be used in exchanging fluid from the power steering system 10*a*, a suction/delivery probe 40 is inserted into the reservoir portion 18 through the fill opening 20. The suction/delivery probe 40 includes a pair of side-by-side substantially parallel, shape retaining, and possible rigid conduits 42, 44. The conduits 42, 44 may be of flexible nature if desired, but they are most preferably of shape-retaining nature so that the relationship of the lower end openings 42*a*, 44*a* of these conduits can be reliably maintained. Preferably, the conduits 42, 44 are mutually secured to one another by a clip member 45 encircling both of these conduits. As is seen in FIG. 2, the lower end openings 42*a*, 44*a* of the conduits 42, 44 are each at the lower end of the respective conduit, and are at different levels within the reservoir 18.

Further attention to FIG. 2 will show that the machine 10*a* includes a pair of pumps 50,52 each driven by a respective one of a pair of electric motors 50*a*, 52*a*. The motors 50*a*, 52*a* are each controlled by a respective one of a pair of switches 54, 56, and a battery of the vehicle 10 is utilized as a power source for the motors 50*a*, 52*a*, and the associated pumps 50 52. Pump 50 draws fluid from conduit 42 via an interconnecting flexible hose 42*b*, and pump 52, delivers fluid to conduit 44 via an interconnecting flexible hose 44*b*, both of which are indicated on FIG. 2 by the fluid flow direction arrows associated with these elements. A hose or conduit 58 leads from pump 50 to a waste fluid container 60; while a hose or conduit 62, having a suction tube portion 62*a* inserted into a container 64 of new power steering fluid 66 connects to the pump 52.

Still viewing FIG. 2, it is seen that the pump portion 14*a* includes a fluid intake port 68 disposed near the bottom of reservoir 18, while the low pressure hose 26 connects to a fitting 70 (best seen in FIG. 1) providing a port 70*a* by which low pressure fluid is returned to reservoir 18. As is seen best in FIG. 2, the designed fluid level 72 in reservoir 18 is above port 68, and is about at the level of port 70*a*. During operation of the engine 12 of the vehicle 10, the pump portion 14*a* draws fluid in at port 68, and delivers this fluid pressurized via the hose or conduit 28, as was explained above in connection with FIG. 1. The low pressure fluid from the power steering unit 30 is returned to the reservoir 18 via port 70*a*.

Now, when the machine 38 is to be used to service the power steering system 14, the suction/delivery probe 40 is inserted into the reservoir 18*a*, and the pump 50 is operated by closure of switch 54 to withdraw fluid down to the level of lower end opening 42*a*. As is noted, this level is still above the level of pump inlet port 68. Next, the engine 12 is started, operating pump 14*a*, and the two pumps 50 and 52 then both also operated by closure now also of the switch 56. With both pumps 50 and 52 operating, new power steering fluid is delivered via probe 40 to the end opening 44*a* to a low level in the reservoir 18 generally adjacent to the inlet port 68 of the pump portion 14*a*. Conversely, as fluid from the power steering system 10*a* is returned into the reservoir 18 via port 70*a*, it is available to be suctioned from this reservoir by operation of pump 50. At first, essentially all of the fluid returned into the reservoir 18 will be old fluid which it is desired to withdraw from the system 10*a*.

In order to facilitate removal of essentially all of the old power steering fluid from the system 10*a*, and replacement of this old fluid with new power steering fluid, it is desirable to exercise the steering unit 30, so that the hydraulic actuator of this steering unit will be run from one extreme of its movement to the other, thus discharging the old fluid from the two sides of this double-acting actuator, and replacing this old fluid with new fluid received into the reservoir 19 via conduit 44 and into pump portion 14*a* via port 68. As this exercise of the power steering unit 30 is conducted by turning the steering wheel 34 from one extreme of its movement to the other and back again, the old power steering fluid will be removed from the steering unit 30 to be replaced by new fluid as explained above. However, it is easily seen that as old fluid from the power steering system 10*a* is returned to the reservoir 18 it has an opportunity for admixture with the new fluid in this reservoir.

The Applicant has, however, discovered that by use of the suction/delivery probe 40 as depicted and described herein, a generally satisfactory stratification of the power steering fluid in the reservoir 18 can be maintained, with new fluid at the lower level adjacent to the inlet port 68 of the pump portion 14*a*, and old fluid at the upper level of the reservoir 18 where it is available to be suctioned out by conduit 42. Consideration of the way the new power steering fluid is introduced near the bottom of reservoir 18 may suggest that the new fluid fills the reservoir 18 from the bottom, and the old fluid is welled up by new fluid entering from below, an is suctioned to the waste container by conduit 42. Also, in that part of the service procedure during which the pump 14*a* is operating (i.e., because the engine 12 of the vehicle 10 has been started), and during which the power steering system 10*a* is exercised to bring the old fluid from the system to the reservoir 18, the pump 14*a* is drawing new power steering fluid from the bottom of reservoir 18 via intake port 68. Thus, the pump 14*a* by immediately taking into the power steering system some of the new fluid as this new fluid is delivered from conduit 44, prevents this new fluid from being mixed with old fluid, and actually assists in improving the economy of flushing operation that can be conducted with the machine 10 from the stand point of reducing the multiple of system fluid volumes of new fluid which will be required to accomplish a complete flushing with machine 10. In this respect, it must be noted that the conduit 44 delivers the new power steering fluid to a lower part of the reservoir 18, thus maintaining a "puddle" of new power steering fluid near the intake port 68 for the pump 14*a*.

Of course, perfect separation of the new and old fluids is not maintained, nor need it be maintained. The Applicant has determined that to the extent that some mixing of old and new fluid in the reservoir (as well as such mixing of the old and new fluid as undoubtedly takes place at other locations of the power steering system 10*a* as the new fluid flushes the old fluid out), indicates that about twice as much new fluid be provided into the reservoir 18 during a service procedure as the system 10*a* holds when full. Thus, about one system volume of old fluid is withdrawn from the system 10*a*, along with about one system volume of mixed new and old fluid. The fluid remaining in the system 10*a* after a service according to this invention is substantially new fluid.

Further to the above, it will be apparent that the power steering system 10*a* cannot ever be damaged by dry running of the pump portion 14*a*. First of all, the suction conduit 42 is at its lower end opening 42*a* always positioned well above the lower extent of the reservoir 18, and well above the inlet port 68 for the pump portion 14*a*. As a result, although the pump portion 14*a* is uniquely vulnerable to damage by dry running as was explained above, this dry running can never happen because of the use of the present service machine 38. Even if a user of the machine 38 allows the reservoir 64 to run completely dry of new power steering fluid, and still allows the machine 38 and vehicle 10 to run, the reservoir 18 will have a fluid "puddle" as deep as the level of end opening 42*a* above intake port 68. This fluid "puddle" is more than adequate to safeguard the pump 14 against damage from dry running.

After the service of the power steering system 10*a* is completed, the probe 40 is removed from the reservoir 18, and the machine 38 is disconnected from the battery of the vehicle. The cap 24 is replaced on fill opening 20, and the vehicle is then ready to return to service.

While the present invention has been depicted, described, and is defined by reference to a single particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. For example, it is apparent that the pumps 50 and 52 need not be operated by use of electrical power from the vehicle under service. Line power could be used to operate one or both of these pumps. Further, both pumps 50 and 52 can be operated by a single electric motor, thus making the machine 38 less expensive to manufacture.

Accordingly, the depicted and described preferred embodiment of the invention is to be understood as being exemplary only, and is clearly not exhaustive of the scope of the invention. Consequently, the invention is intended to be limited only by the spirit and scope of the appended claims, giving full cognizance to equivalents in all respects.

I claim:

1. A fail-safe probe for use in servicing an automotive power steering system of the type having a power steering pump and a reservoir holding power steering fluid, the reservoir having an upper reservoir opening and a design upper fluid level for power steering fluid in the reservoir, the power steering pump being adapted to withdraw power steering fluid from a lower portion of the reservoir and returning power steering fluid to the reservoir, said probe being effective both for simultaneously removing old power steering fluid from the reservoir while replacing new power steering fluid into the reservoir, and always maintaining a sufficient puddle of power steering fluid in a lower portion of the reservoir so that the power steering pump cannot be subjected to dry running, said probe comprising:

a duality of shape-retaining elongate and generally parallel conduit members arranged generally in side-by-side relationship, said probe being sized and adapted for insertion of a portion of said duality of conduit members though said upper reservoir opening into said reservoir, a first of said duality of conduit members having a lower end opening disposed adjacent to the lower portion of the reservoir for delivery of new power steering fluid, a second of said duality of conduit members having a respective lower end opening disposed within a range of height dimensions, of the reservoir, said range of height dimensions extending from a lower level which is at substantially the same level as said lower end opening of the first conduit member, and said range of height dimensions extending upwardly from said lower level to an upper level at the design upper fluid level for the power steering fluid in the reservoir, whereby said first conduit member delivers new power steering fluid to the lower portion of the reservoir to be withdrawn by the power steering pump, and second conduit member is effective to suction old power steering fluid from the reservoir at said lower end opening thereof within said range of height dimensions.

2. The probe of claim 1 wherein said first conduit member extends downwardly in the reservoir so that said lower end opening thereof is substantially at a bottom of the reservoir.

3. The probe of claim 1 wherein said second conduit member lower end opening is disposed above the level of the lower end opening of the first conduit member, and below the design upper fluid level for power steering fluid in the reservoir.

4. The probe of claim 1 wherein said duality of conduit members are each fabricated of a shape retaining but flexible polymer plastic material.

5. The probe of claim 1 in which said duality of conduit members are secured mutually to one another by use of a clip member encircling both conduit members.

6. A fail-safe machine for service of an automotive power steering system having a power steering pump and a power steering fluid reservoir, the power steering fluid reservoir having an upper opening and a design upper power steering fluid level, and the power steering pump ingesting power steering fluid from a lower extent of the reservoir, said machine comprising:

a pair of pumps each driven by a motor, one of said pair of pumps moving new power steering fluid from a source thereof into the power steering fluid reservoir via a probe member, and the other of said pair of pumps simultaneously removing old power steering fluid from the power steering fluid reservoir via said probe member;

fluid flow hoses connecting said pair of pumps and said probe member; and said probe member including a pair of conduits each extending into the power steering fluid reservoir, a first of said pair of conduits receiving new power steering fluid from said first pump and delivering this new power steering fluid through an opening of said first conduit to a lower extent of the power steering fluid reservoir for ingestion by the power steering pump, the other of said pair of conduits having an opening for fluid suction which is positioned at a level of the reservoir above said opening of said first conduit and below the design upper power steering fluid level, and said second conduit suctioning old power steering fluid from the power steering fluid reservoir at a level above said opening of said first conduit in response to operation of said second pump.

7. The machine of claim 6 wherein each of said pair of pumps is driven by a separate motor.

8. The machine of claim 7 wherein said separate electric motors are driven by electrical power from a vehicle while the vehicle is having the power steering system thereof serviced by said machine.

9. A method of servicing a power steering system, said method comprising steps of:

simultaneously removing old power steering fluid from a fluid reservoir of the power steering system while delivering new power steering fluid into the fluid reservoir;

delivering the new power steering fluid into a lower extent of the fluid reservoir while a power steering system pump operates to ingest from the lower extent of the reservoir at least a portion of the new power steering fluid delivered into the fluid reservoir; and suctioning old power steering fluid from the fluid reservoir at a level sufficiently above the lower extent of the reservoir and the new power steering fluid delivered into this lower extent of the reservoir such that only a portion but not all of the power steering fluid in the fluid reservoir can be suctioned therefrom.

* * * * *